US008451285B2

(12) United States Patent
Chen et al.

(10) Patent No.: US 8,451,285 B2
(45) Date of Patent: May 28, 2013

(54) METHOD FOR IMPROVING MOTION BLUR AND CONTOUR SHADOW OF DISPLAY AND DISPLAY THEREOF

(75) Inventors: Eddy Giing-Lii Chen, Miao-Li County (TW); Kuo-Feng Li, Miao-Li County (TW); Sheng-Tien Cho, Miao-Li County (TW); Tien-Feng Chiang, Miao-Li County (TW); Kai-Chieh Chan, Miao-Li County (TW); Sz-Hsiao Chen, Miao-Li County (TW)

(73) Assignee: Chimei InnoLux Corporation, Miaoli County (TW)

( * ) Notice: Subject to any disclaimer, the term of this patent is extended or adjusted under 35 U.S.C. 154(b) by 315 days.

(21) Appl. No.: 12/862,762

(22) Filed: Aug. 25, 2010

(65) Prior Publication Data

US 2011/0063320 A1 Mar. 17, 2011

(30) Foreign Application Priority Data

Sep. 16, 2009 (CN) ..... 2009 1 0307093

(51) Int. Cl.

| | |
|---|---|
| ***G09G 5/02*** | (2006.01) |
| ***G09G 5/10*** | (2006.01) |
| ***G09G 3/36*** | (2006.01) |

(52) U.S. Cl.
USPC ..... 345/589; 345/690; 345/89

(58) Field of Classification Search
USPC ..... 345/589
See application file for complete search history.

(56) References Cited

U.S. PATENT DOCUMENTS

| | | | | |
|---|---|---|---|---|
| 6,683,595 | B2 | 1/2004 | Ikeda | |
| 2005/0207046 | A1 * | 9/2005 | Tamura | 359/891 |
| 2008/0170126 | A1 * | 7/2008 | Tico et al. | 348/208.6 |
| 2008/0279470 | A1 * | 11/2008 | Warmuth et al. | 382/255 |

* cited by examiner

*Primary Examiner* — Ulka Chauhan
*Assistant Examiner* — Sae Won Yoon
(74) *Attorney, Agent, or Firm* — Li & Cai Intellectual Property (USA) Office

(57) ABSTRACT

A method for improving motion blur and contour shadow of a display displaying images having a number of frames includes transforming a second average gray scale into a third average gray scale when a first average gray scale for displaying a first frame is unequal to the second average gray scale for displaying a second frame. A luminance corresponding to the second frame is generated according to the third average gray scale and at least one luminance query table. The third average gray scale is greater than the first average gray scale and the second average gray scale or less than the first average gray scale and the second average gray scale.

9 Claims, 12 Drawing Sheets

METHOD FOR IMPROVING MOTION BLUR AND CONTOUR SHADOW OF DISPLAY AND DISPLAY THEREOF

BACKGROUND

1. Technical Field

The disclosure generally relates to displays, and particularly, to a method for improving motion blur and contour shadow of a display and display thereof.

2. Description of the Related Art

Display panels are often are driven by using a hold-type drive method, which may cause motion blur, reducing dynamic image quality of the display panels. Referring to FIG. 9, the solid line represents an actual luminance curve of the general display panels using the hold-type drive method, and the broken line represents a viewing luminance curve of the conventional display panels using the hold-type drive method. The frame rate can be set to be 60 Hz; however, the display panels generate motion blur due to the viewing luminance values superimposing with the actual luminance values shown on the solid line.

A pulse-type drive method is often used on the display panels to solve the motion blur. Referring to FIG. 10, the solid line represents an actual luminance curve of the conventional display panels using the pulse-type drive method, and the broken line represents a viewing luminance value of the display panels using the pulse-type drive method. The frame rate can be still set to be 60 Hz; the average luminance values viewed by the user are close to the actual luminance values of the display panels, thus the display panels do not result in motion blur.

The general pulse-type driver method mainly uses black frame insertion technology. A single frame can be separated into two or more consecutive and adjacent sub-frames by using the black frame insertion technology, in which the later sub-frame is a black frame. Also referring to FIG. 11, F(n), F(n+1), and F(n+2) represent three consecutive frame, among them, each frame corresponds to two sub-frames. For example, frame F(n) corresponds to sub-frames F(n)_1 and F(n)_2, frame F(n+1) corresponds to sub-frames F(n+1)_1 and F(n+1)_2, and frame F(n+2) corresponds to sub-frames F(n+2)_1 and F(n+2)_2, among them, F(n)_2, F(n+1)_2, and F(n+2)_2 are the black sub-frames in the black frame insertion technology.

FIG. 12 shows a schematic view illustrating luminance of all the frames and the sub-frames shown in the FIG. 11. Provided that the frame rates of the frames F(n), F(n+1), and F(n+2) are set as 60 Hz, then the frame rates of the sub-frames F(n)_1, F(n)_2, F(n+1)_1, F(n+1)_2, F(n+2)_1 and F(n+2)_2 are 120 Hz. The black sub-frames F(n)_2, F(n+1)_2, and F(n+2)_2 respectively have low luminance in their corresponding frames F(n), F(n+1), and F(n+2), so that each black sub-frame is inserted between two bright sub-frames. Thus, the display panel can display images with double frame rate and alternately dark and bright sub-frames, resulting in elimination of motion blur.

However, since the bright sub-frame and the black sub-frame as a single frame are displayed at the same time, there is an obvious luminance difference, namely flicker, on the screen. Thus, even though motion blur is eliminated, image quality is reduced due to flicker phenomenon. Furthermore, the average luminance of the single frames is still reduced due to the insertion of the black sub-frames.

Therefore, there is room for improvement within the art.

SUMMARY OF THE DISCLOSURE

An embodiment of the disclosure provides a method for improving motion blur and contour shadow of a display, and the method includes the following steps. Transforming a second average gray scale into a third average gray scale when a first average gray scale for displaying a first frame unequal to the second average gray scale for displaying a second frame. Generating a luminance corresponding to the second frame according to the third average gray scale and at least one luminance query table. The third average gray scale is greater than the first average gray scale and the second average gray scale or less than the first average gray scale and the second average gray scale.

An embodiment of the disclosure provides a display for executing a method for improving motion and contour shadow, and the display includes a display panel for displaying various frames and images and a timing controller electrically connected to the display panel. The timing controller a frame memory for receiving and temporarily storing a first frame, a gray scale curve amending module electrically connected to the frame memory and receiving a second frame, a first luminance query table electrically connected to the display panel and the gray scale curve amending module, and a second luminance query table electrically connected to the display panel, the frame memory, and the gray scale curve amending module. The first frame corresponds to a first average gray scale and the second frame corresponds to a second average gray scale and is received later than the first frame. When the first gray scale is unequal with second gray scale, the gray scale curve amending module processes and transforms the second gray scale into a third average gray scale, the first luminance query table outputs a first sub-frame image to the display panel according to the third average gray scale, the second luminance query table outputs a second first sub-frame image to the display panel according to the second average gray scale. The display panel displays the second frame according to the first sub-frame and the second sub-frame. The third average gray scale is greater than the first average gray scale and the second average gray scale is less than the first average gray scale and the second average gray scale.

BRIEF DESCRIPTION OF THE DRAWINGS

Many aspects of a method for improving motion blur and contour shadow of a display and display thereof can be better understood with reference to the following drawings. The components in the drawings are not necessarily drawn to scale, the emphasis instead being placed upon clearly illustrating the principles of the exemplary method for improving motion blur and contour shadow of a display and display thereof. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
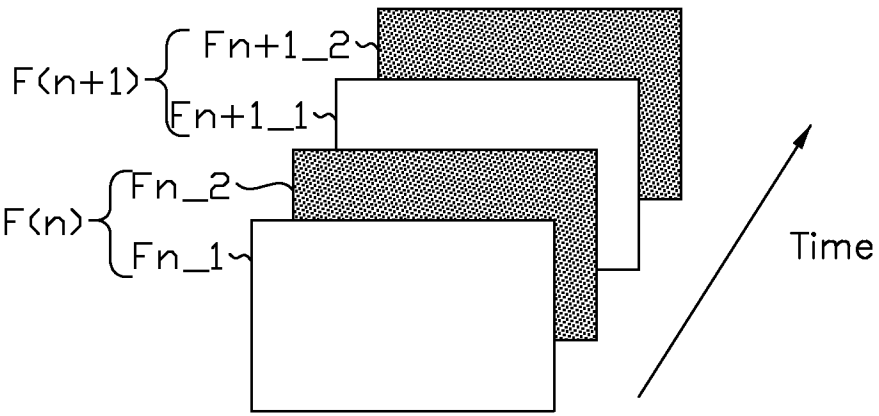
FIG. 1 is a schematic view illustrating frames F(n) and F(n+1) respectively generating two sub-frames Fn_1, Fn_2, and Fn+1_1, Fn+1_2, according to an exemplary embodiment of the disclosure.
Figure 2:
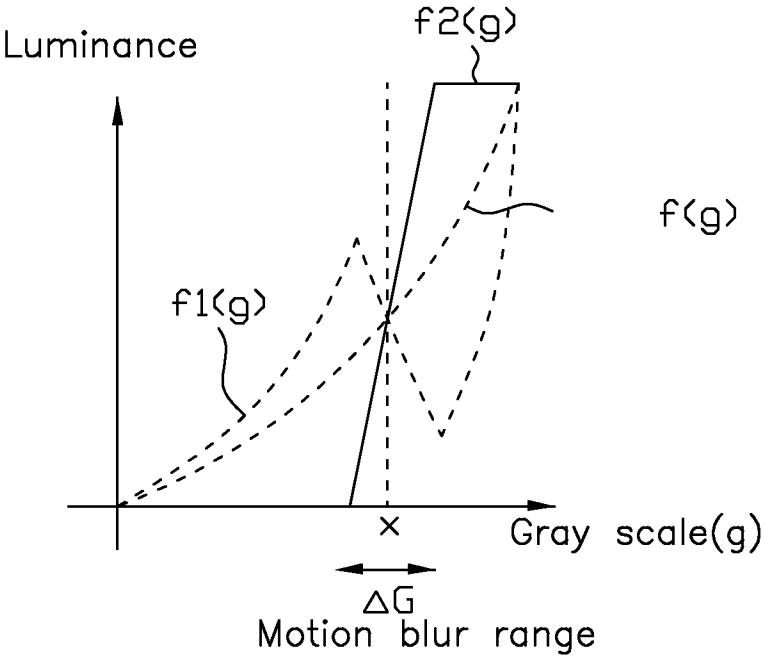
FIG. 2 is a schematic view illustrating for separating a gamma curve f(g) with average luminance into a first gamma cure f1(*g*) and a second gamma cure f2(*g*) according to a predetermined gray scale x.

Gamma curve is a relation function used for illustrating a relationship between luminance and corresponding gray scales of a display image, namely, a motion picture response function. Referring to FIGS. 1 and 2, a gamma curve f(g) is divided into a first gamma cure f1(*g*) and a second gamma cure f2(*g*) according to a predetermined gray scale x, and frames F(n) and F(n+1) respectively generate two sub-frames Fn_1, Fn_2, and Fn+1_1, Fn+1_2. The luminance of the frames F(n) and F(n+1) is displayed based on the gamma curve f(g), the luminance of the sub-frames Fn_1 and Fn+1_is displayed based on the first gamma curve f1(*g*), and the luminance of the sub-frames Fn_2 and Fn+1_2 is displayed based on the second gamma curve f2(*g*).

In detail, the sub-frame Fn_1 and Fn+1_1 correspond to the output luminance shown on the gamma curve f1(*g*), and the sub-frame Fn_2 and Fn+2_2 correspond to the output luminance shown on the gamma curve f2(*g*). When the gray scale of the display image is less than the predetermined gray scale x, the luminance of the first gamma curve f1(*g*) is greater than the luminance of the second gamma curve f2(*g*), and the first gamma curve f1(*g*) crosses the second gamma curve f2(*g*) at the predetermined gray scale x. When the gray scale of the display image is beyond the predetermined gray scale x, the luminance of the first gamma curve f1(*g*) is less than the luminance of the second gamma curve f2(*g*). Thus the gamma curves f1(*g*) and f2(*g*) can be used to represent the luminance of the single frame, and still maintain the average luminance f(g) of the single frame. Motion blur range G, as shown in FIG. 2, represents a considerable change in luminance associated with a little change in the gray scales, resulting in generating motion blur. When the length of the motion blur range AG is smaller, namely, the slope of the gamma curves f1(*g*) and f2(*g*) in the motion blur range AG is greater, then the motion blur is more inconspicuous.

Figure 3:
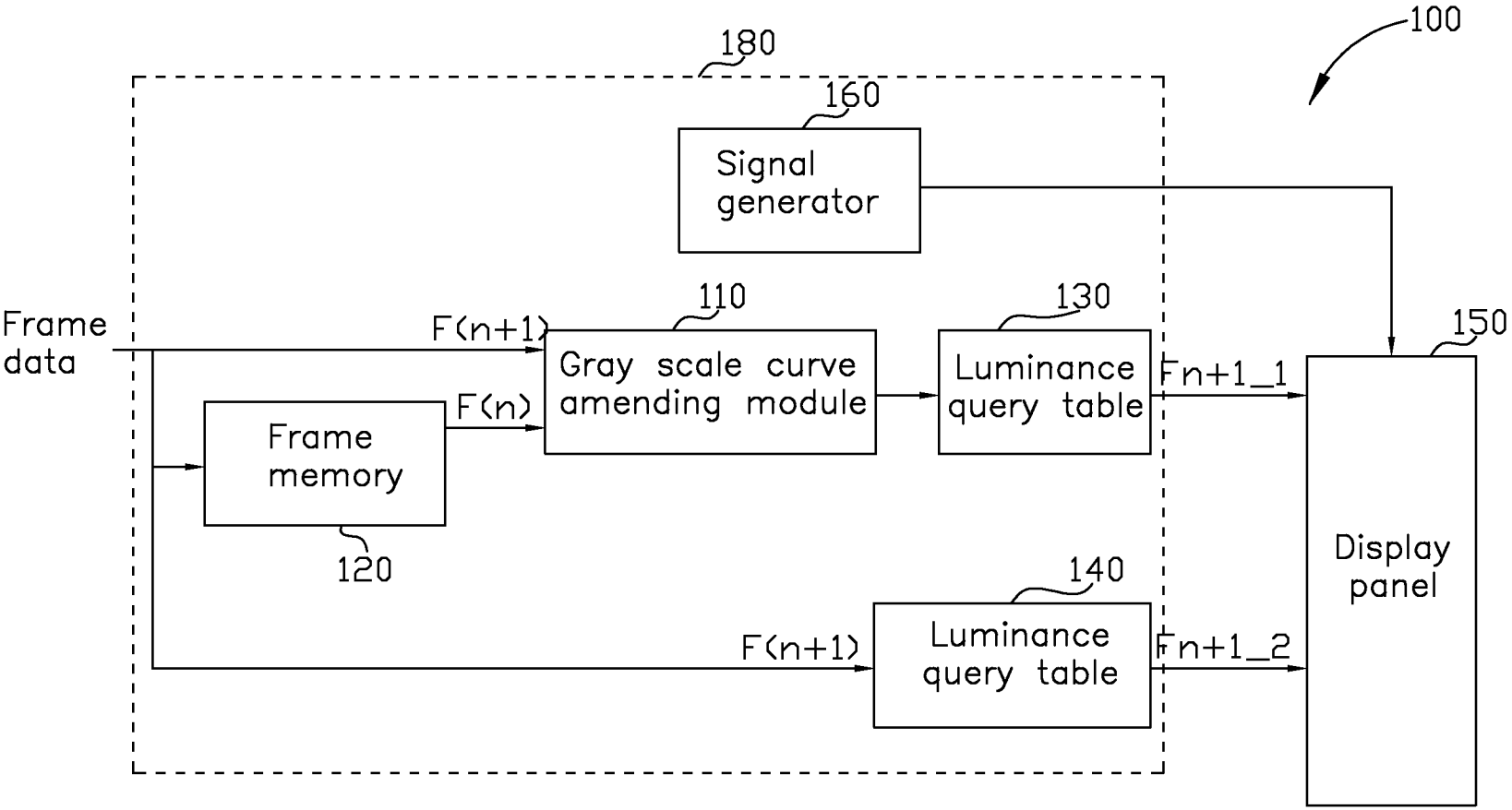
FIG. 3 is a block diagram of a display used for improving motion blur, according to an exemplary embodiment of the disclosure.

FIG. 3 shows an exemplary embodiment of a display 100 for processing a method for improving motion blur and contour shadow of a display and display. The display 100 includes a timing controller 180 and a display panel 150. The timing controller 180 includes a gray scale curve amending module 110, a frame memory 120, two luminance query tables 130 and 140, and a signal generator 160. The display panel 150 is electrically connected to the luminance query tables 130, 140, and the signal generator 160. The gray scale curve amending module 110 is electrically connected to the frame memory 120, the luminance query tables 130. The frame memory 120 is electrically connected to the luminance query table 140.

The timing controller 180 receives and processes frame image data as a frame unit, and provides two corresponding sub-frames Fn+1_1 and Fn+1_2 image data to the display 150. The display panel 150 receives the two sub-frames Fn+1_1 and Fn+1_2 image data to generate corresponding images. The signal generator 160 generates and provides various control signals such as sync signals or data enable signals, and transmits the control signals to the display panel 150 to control the image timing of the display panel 150. The frame memory 120 temporarily stores the frame data, such as the frame F(n) shown in FIG. 3.

The gray scale curve amending module 110 processes and amends gray scales of the sub-frames to generate corresponding amended gray scales. When the average gray scales of the received frame F(n+1) and the frame F(n) stored in the frame memory 120 are not unequal to each other, the gray scale curve amending module 110 processes and amends the gray scales of the corresponding sub-frames Fn+1_1 according to the average gray scales of the frames F(n) and F(n+1) to generate corresponding amended gray scale of the sub-frame Fn+1_1.

The luminance query table 130 controls the luminance of the sub-frame Fn+1_1 according to the gray scales from the gray curve amending module 110, and outputs a first sub-frame image data included in the sub-frame Fn+1_1. The luminance query table 140 controls the luminance of the sub-frame Fn+1_2 according to the gray scales of the received sub-frame F(n+1), and outputs a second sub-frame image data included in the sub-frame Fn+1_2. A first motion picture response function (namely, the first gamma curve f1(*g*)) is stored in the luminance query table 130, so that the luminance query table 130 includes all the gray scales of the sub-frame Fn+1_1 to look up the luminance corresponding to the gray scales. Similarly, a second motion picture response function (namely, the second gamma curve f2(*g*)) is stored in the luminance query table 140, so that the luminance query table 140 includes all the gray scales of the sub-frame Fn+1_2 to look up the luminance corresponding to the gray scales.

Figure 4:
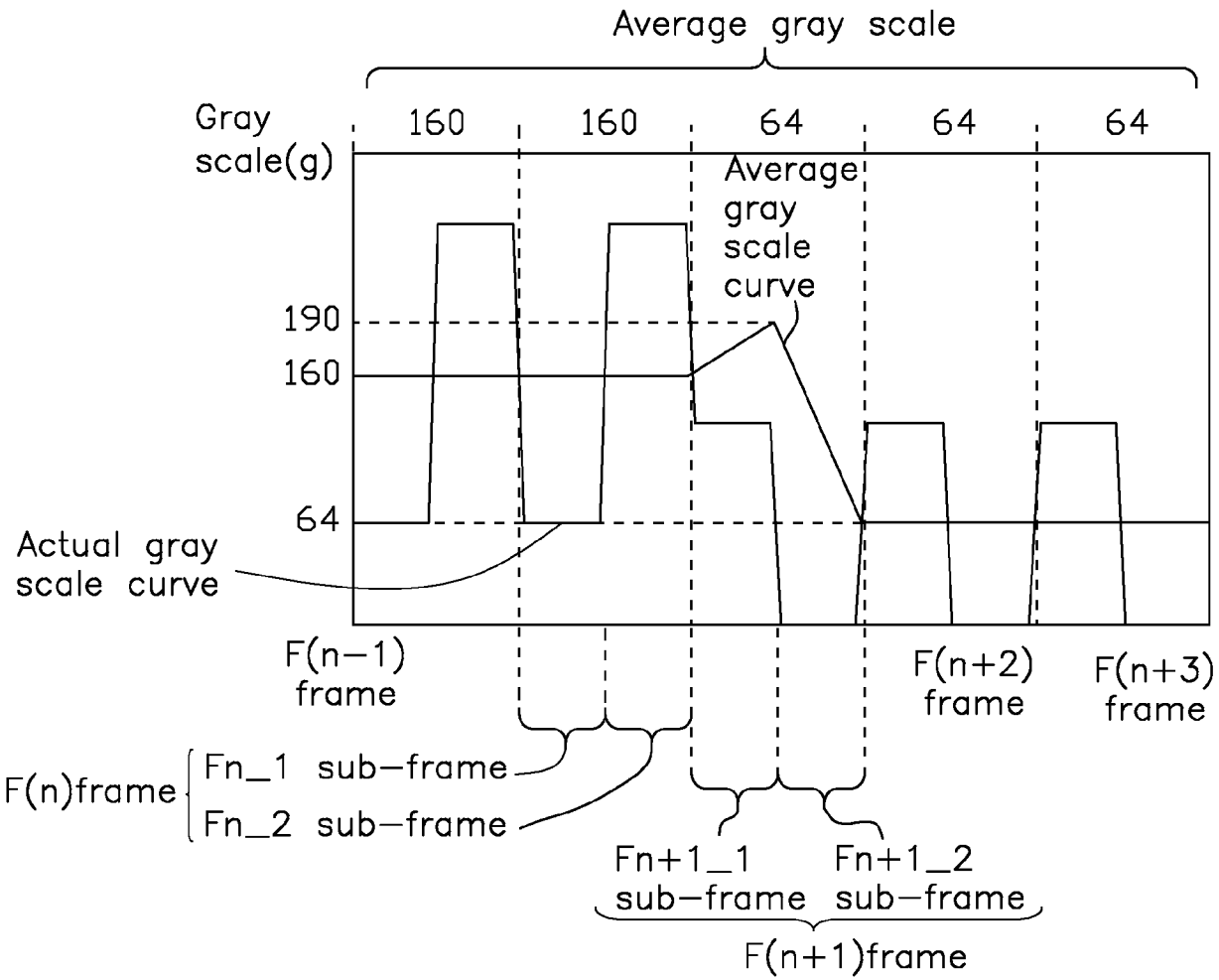
FIGS. 4, 5, 6, and 7 are principle schematic views illustrating improvement of motion blur using a gray scale curve amending module shown in FIG. 3.
Figure 5:
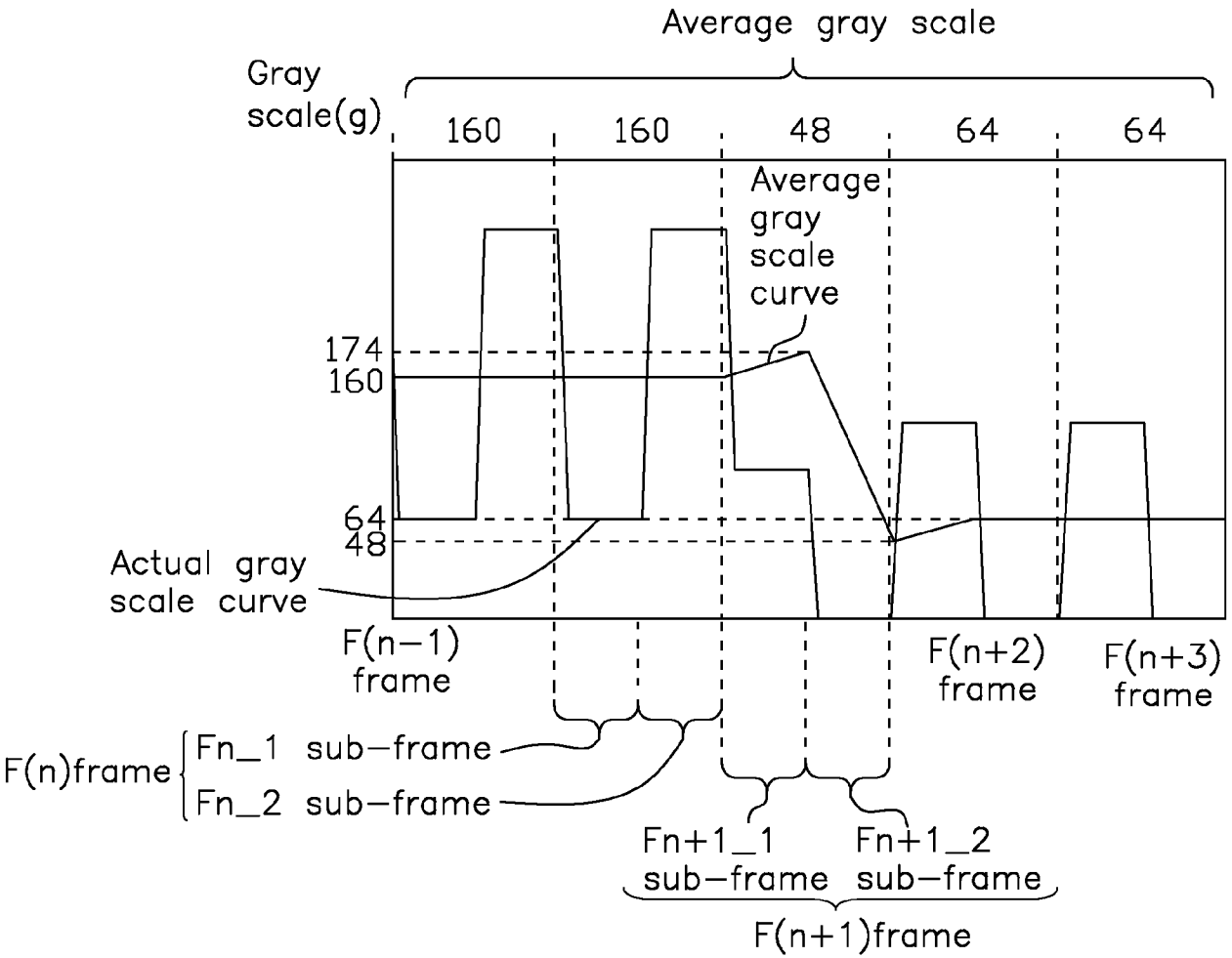

Referring to FIGS. 3, 4, and 5, FIG. 4 shows different gray scales corresponding to multiple consecutive frames F(n−1), F(n), F(n+1), F(n+2), and F(n+3) when the gray scale curve is not amended by the gray scale curve amending module 110 and frame memory 120. FIG. 5 shows different gray scales corresponding to multiple consecutive F(n−1), F(n), F(n+1), F(n+2), and F(n+3) when the gray scale curve is amended by the gray scale curve amending module 110 and frame memory 120. In detail, each frame as shown in FIGS. 4 and 5 corresponds to two consecutive sub-frames showed in FIGS. 1 and 2. For example, when the timing controller 180 displays frame F(n+1), the frame F(n+1) includes and displays two consecutive sub-frames Fn+1_1 and Fn+1_2, the sub-frames Fn+1_1 corresponds to the first gamma curve f1(*g*), and the sub-frames Fn+1_2 corresponds to the second gamma curve f2(*g*) shown in FIG. 2.

In FIG. 4, assuming that the timing controller 180 receives the successive frames F(n−1), F(n), F(n+1), F(n+2), and F(n+3), the corresponding gray scales of the frames F(n−1), F(n), F(n+1), F(n+2), and F(n+3) are 160, 160, 64, 64, and 64. That is an average gray scale of the frames is reduced from 160 to 64. When the frame F(n) and the frame F(n+1) are continuously output from the timing controller 180, the corresponding average gray scale of the frame F(n+1) is raised to 190 from 160, and then reduced from 190 to 64, resulting in generating a larger slope on an average gray scale curve shown on FIG. 4. When the average gray scale is transiently raised to 190 from 160, the luminance of the display images on the display panel 150 is accordingly increased, causing contour shadow of the images. The contour shadow is a kind of a circle of bright track or a layer of dark track. When the display panel 150 displays high-brightness images, the bright track is formed around the bright image due to a sudden increase of the image brightness. When the display panel 150 displays low-brightness images, the dark track is formed outside the dark images due to a sudden reduction of the image brightness.

The gray scale curve amending module 110 and the frame memory 120 are used to amend the gray scale curve. When the gray scale of frame F(n+1) is less than the gray scale of the previously-received frame F(n), the gray scale curve amending module 110 processes and amends the gray scale of frame F(n+1), and provides a gray scale which is less than the gray scale of frame F(n+1). When the gray scale of frame F(n+1) is greater than the gray scale of frame F(n), the gray scale curve amending module 110 processes and amends the gray scale of frame F(n+1), and provides a gray scale which is greater than the gray scale of frame F(n+1).

Referring to FIG. 5, for example, in this exemplary embodiment, the gray scale of frame F(n+1) is 64, and the gray scale of frame F(n) is 160. In order to avoid contour shadow, the gray scale curve amending module 110 amends the gray scale of sub-frame Fn+1_1, reduces the gray scale from 190 to 174, and reduces the gray scale of frame F(n+1) from 64 to 48 as shown in FIG. 4. In other words, the gray scale change interval of sub-frame Fn+1_2 is changed from 190-64 to 174-48, so that contour shadow is further eliminated on the display panel 150. The gray scale difference 14 between 160 and 174 can be set as a critical gray scale difference. In addition, the critical gray scale difference is generated according to the gray scale difference 96 between the average gray scale 160 of frame F(n) and the average gray scale 64 of frame F(n+1).

Figure 6:
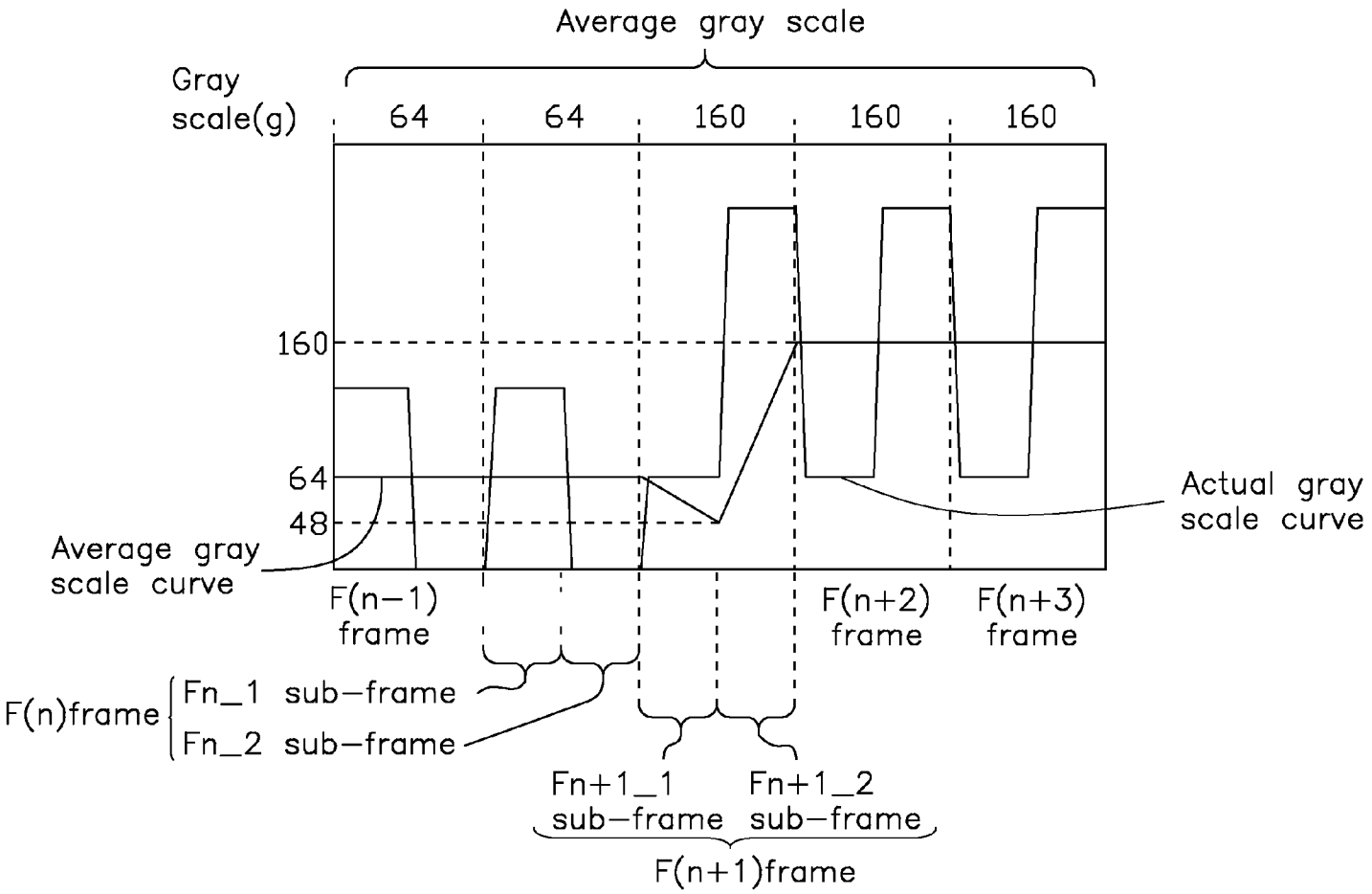

FIG. 6 shows different gray scales corresponding to multiple consecutive frames F(n−1), F(n), F(n+1), F(n+2), and F(n+3) when the gray scale curve is not amended by the gray scale curve amending module 110 and frame memory 120. Among them, the average gray scale of frames F(n) is increased to the average gray scale of F(n+1). Then assuming that the timing controller 180 receives the successive frames F(n), F(n+1), F(n+2), and F(n+3), the corresponding gray scales of the frames F(n−1), F(n), F(n+1), F(n+2), and F(n+3) are 64, 64, 160, 160, and 160, respectively. That is, the average gray scale of the frames is raised from 64 to 160. Thus, When the frame F(n) and the frame F(n+1) are continuously output from the timing controller 180, the corresponding average gray scale is raised from 64 to 160, resulting in generating contour shadow on the display panel 150.

Figure 7:
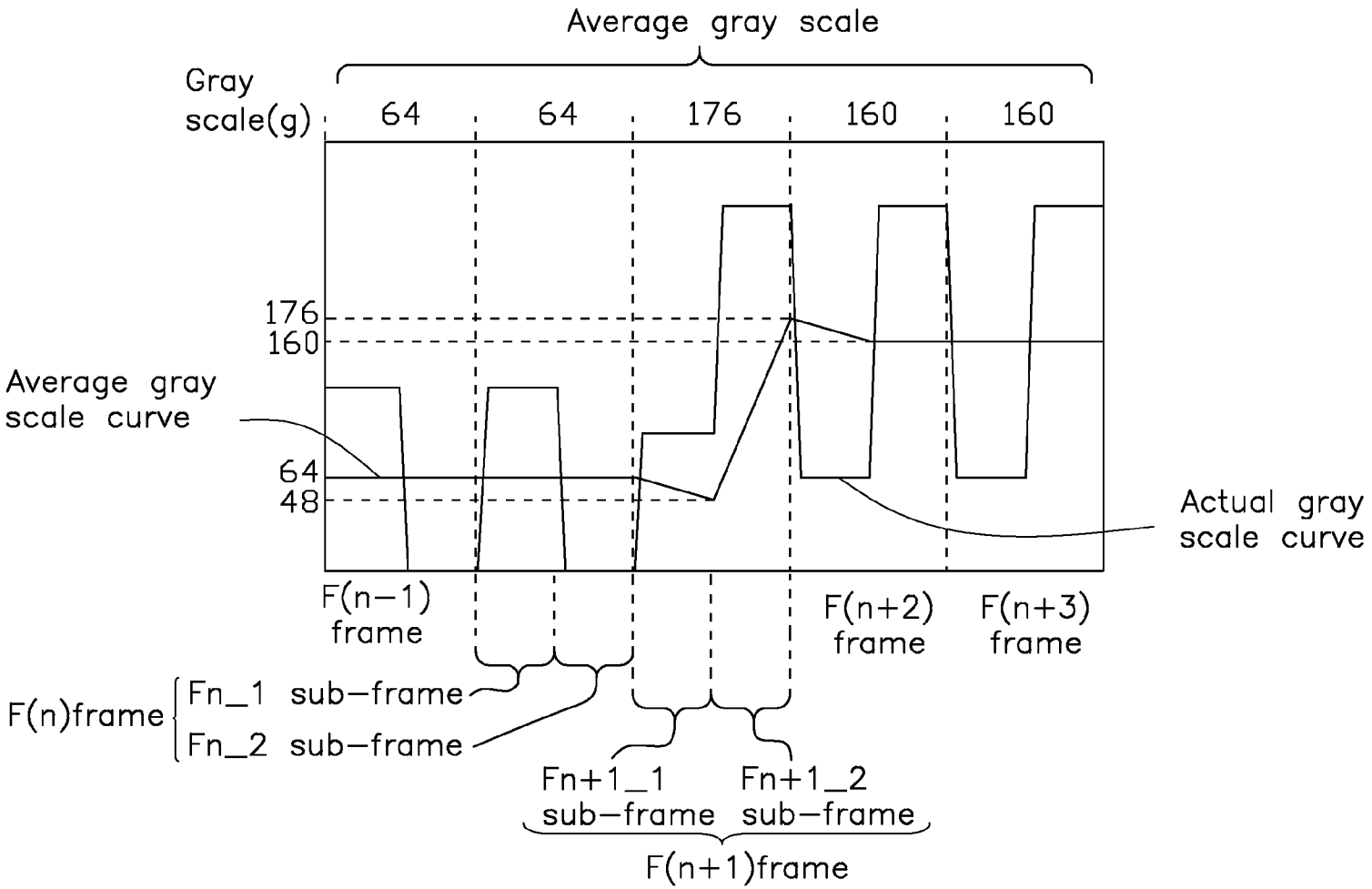

FIG. 7 shows different gray scales corresponding to multiple consecutive F(n−1), F(n), F(n+1), F(n+2), and F(n+3) when the gray scale curve is amended by the gray scale curve amending module 110 and frame memory 120. Among them, the average gray scale of frames F(n) is raised to the average gray scale of frame F(n+1). Then, the gray scale curve amending module 110 and the frame memory 120 are used for amending the average gray scale curve to output corresponding gray scales which are less or greater than the gray scale of frame F(n+1) as shown in FIG. 5, resulting in the avoidance of contour shadowing. The specific descriptions of FIGS. 6 and 7 respectively correspond to FIG. 4 and FIG. 5, so there is no need for detail.

Furthermore, the sub-frame Fn+1_1 not only corresponds to the first gamma curve f1(*g*) shown in FIG. 2, also can correspond to the second gamma curve f2(*g*) in another exemplary embodiments. Similarly, the sub-frame Fn+1_2 not only corresponds to the second gamma curve f2(*g*) shown in FIG. 2, but also can correspond to the first gamma curve f1(*g*) according to actual situation. In other words, the timing controller 180 can control output to the luminance of the frame F(n+1) according to the variation of the gray scales, and both the outputting order of the two sub-frames about the luminance lighting before dimming or dimming before lighting can be used.

Figure 8:
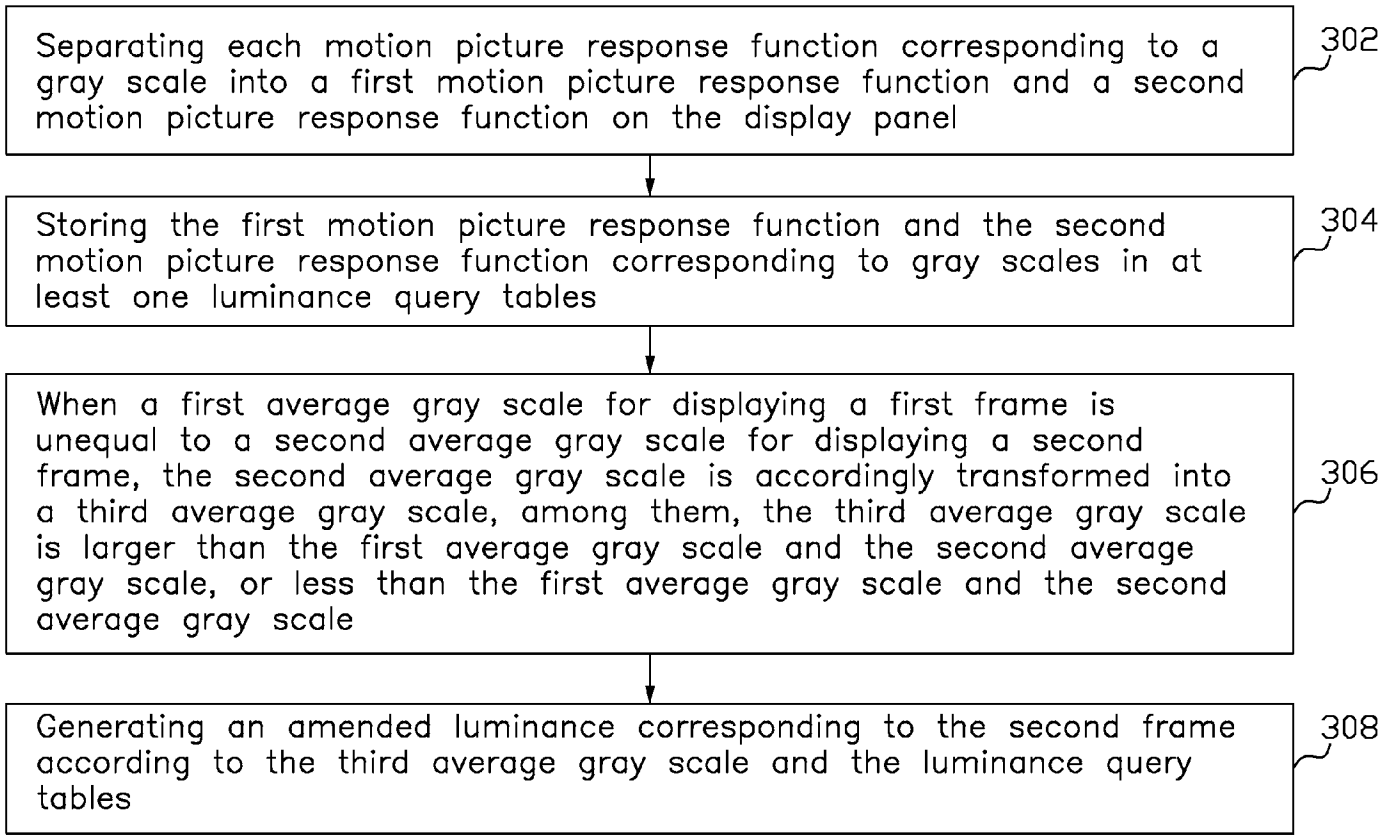
FIG. 8 is a flowchart illustrating a method for improving motion blur and contour shadow of a display according to an exemplary embodiment of the disclosure.
Figure 9:
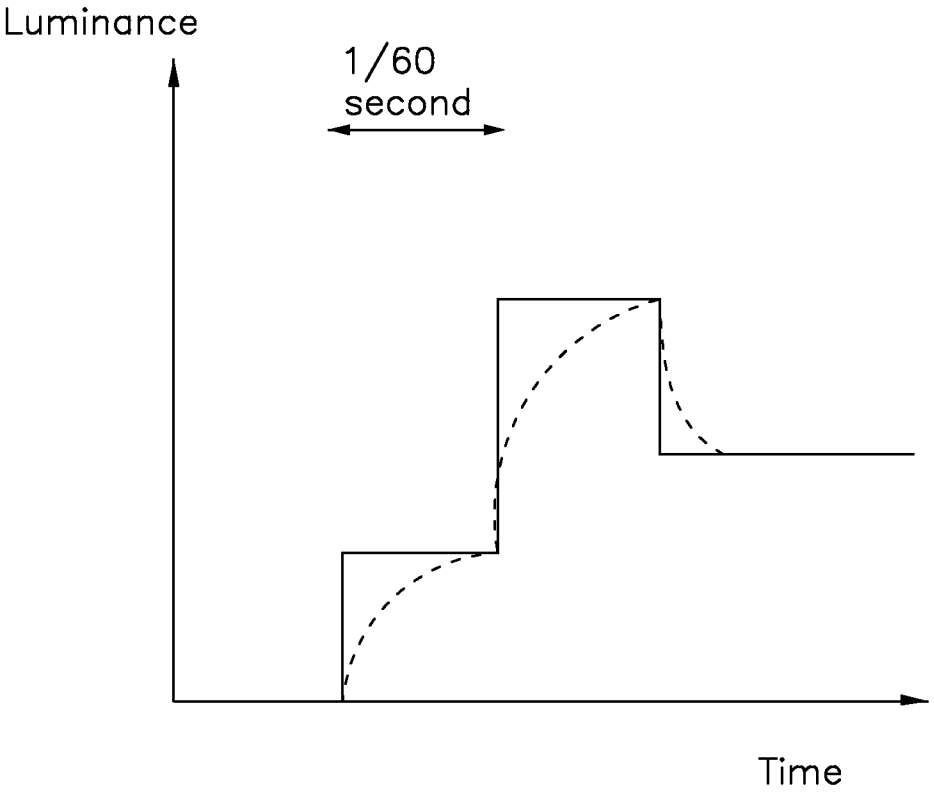
FIG. 9 (RELATED ART)
FIG. 9 is a schematic view illustrating a relationship between time (X-axis) and corresponding luminance values (Y-axis) of a conventional display panel using holding-type method.
Figure 10:
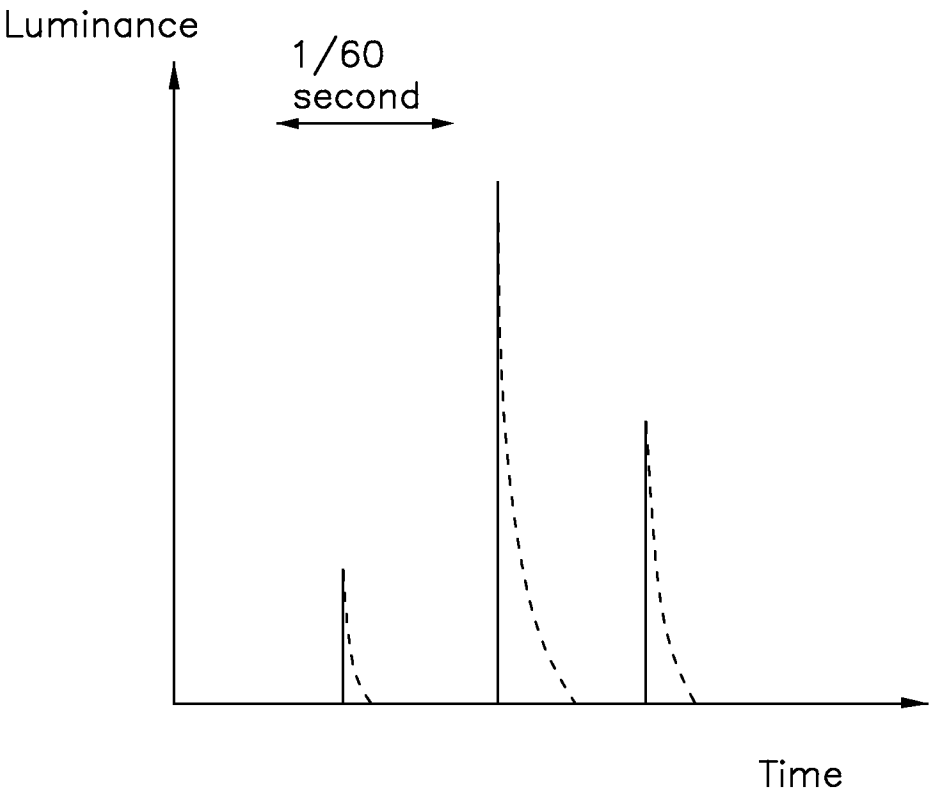
FIG. 10 (RELATED ART)
FIG. 10 is a schematic view illustrating a relationship between time (X-axis) and corresponding luminance values (Y-axis) of the conventional display panel using pulse-type method.
Figure 11:
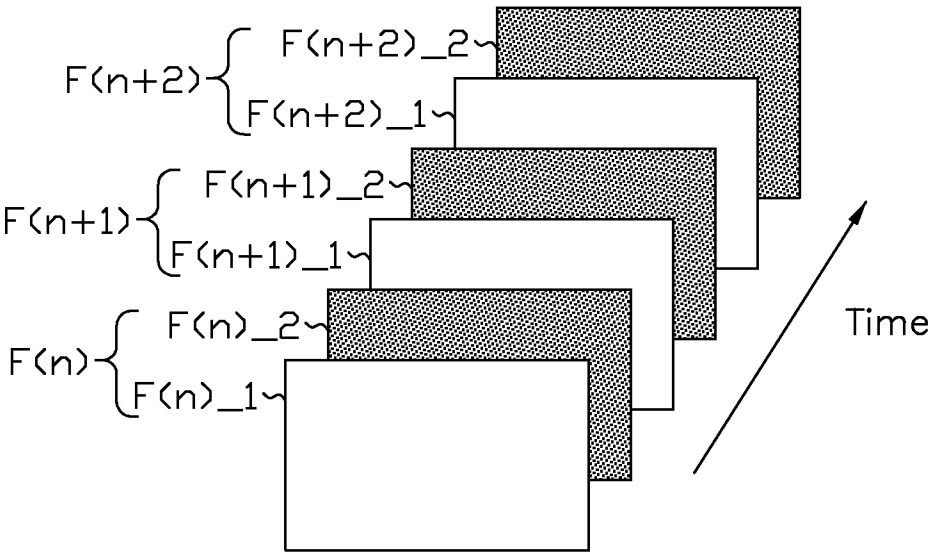
FIG. 11 (RELATED ART)
FIG. 11 is a schematic view showing a single frame generating two adjacent sub-frames using black frame insertion technology.
Figure 12:
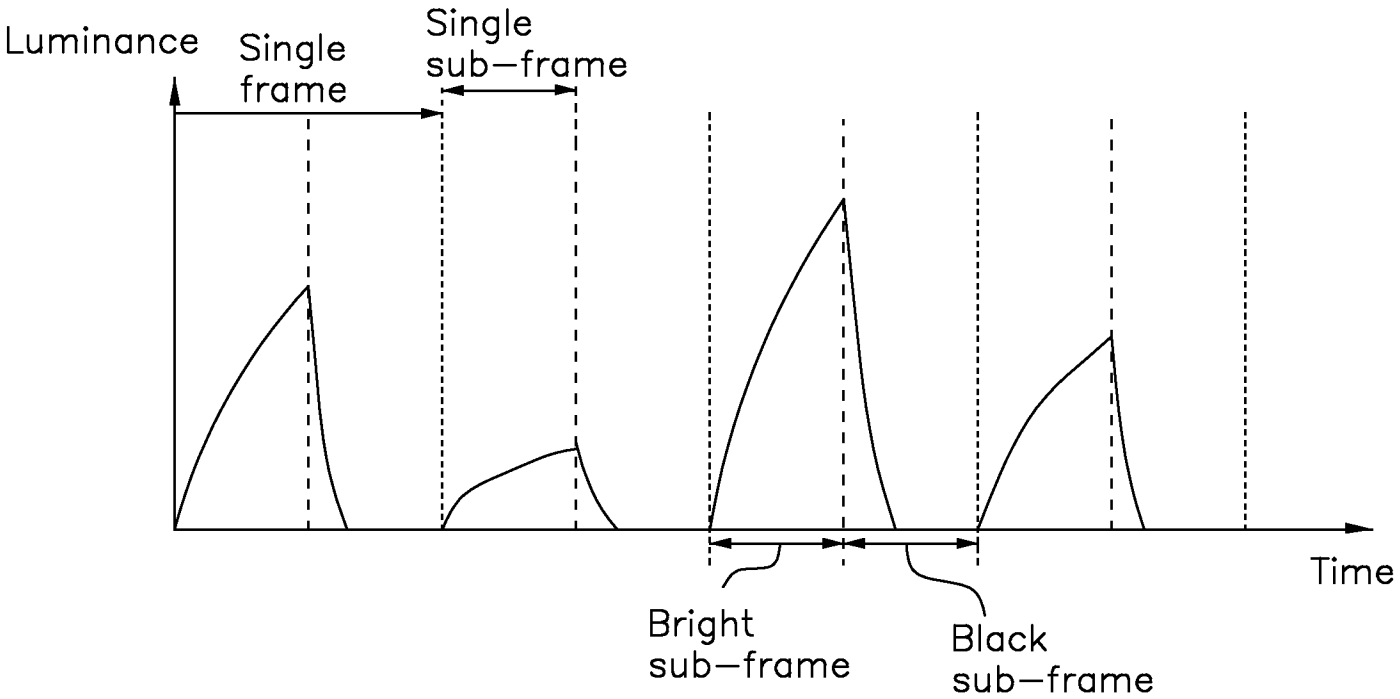
FIG. 12 (RELATED ART)
FIG. 12 is a schematic view illustrating luminance of all the frames and the sub-frames shown in FIG. 11.

Referring to FIG. 8, a method for improving motion blur and contour shadow of the display 100 in accordance with an exemplary embodiment of the disclosure including at least the following steps is depicted.

In step S302, each motion picture response function corresponding to a gray scale is separated into a first motion picture response function and a second motion picture response function on the display panel 150. The display 100 displays a plurality of frame images, each frame image includes a plurality of gray scales, and each gray scale corresponds to one motion picture response function.

In step S304, the first motion picture response function and the second motion picture response function corresponding to gray scales are stored in at least one luminance query table.

In step S306, a first average gray scale is used to display a first frame, a second average gray scale is used to display a second frame, so when the first average gray scale is unequal to the second average gray scale, the second average gray scale is accordingly transformed into a third average gray scale. Among them, the third average gray scale is greater than the first average gray scale and the second average gray scale, or less than the first average gray scale and the second average gray scale.

In step S308, an amended luminance corresponding to the second frame is generated according to the third average gray scale and the luminance query tables.

In summary, while the display 100 displays a plurality of frames, each gamma curve for controlling luminance of frames is separated into gamma curve to display two corresponding sub-frames having different luminance. Besides, the single frame and the previously-received frame are adjusted with a related gray scale curve so that motion blur and contour shadow may be eliminated simultaneously while consecutively outputting two frames having gray scales and having a significant difference with each other.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A method for improving motion blur and contour shadow of a display, the display displaying images having a plurality of frames; the method comprising:

transforming a second average gray scale into a third average gray scale when a first average gray scale for displaying a first frame unequal to the second average gray scale for displaying a second frame; and generating a luminance corresponding to the second frame according to the third average gray scale and at least one luminance query table, wherein when the third average gray scale is greater than the first average gray scale and the second average gray scale, the first average gray scale is less than the second average gray scale, and a gray scale difference between the third average gray scale and the second average gray scale is greater than a critical gray scale difference, or when the third average gray scale is less than the first average gray scale and the second average gray scale, the first average gray scale is greater than the second average gray scale, and the gray scale difference between the third average gray scale and the second average gray scale is less than the critical gray scale difference, wherein the critical gray scale difference is generated according to a gray scale difference between the first average gray scale and the second average gray scale.

2. The method as claimed in claim 1, further comprising separating a motion picture response function corresponding to a gray scale into a first motion picture response function and a second motion picture response function on a display panel of the display.

3. The method as claimed in claim 2, further comprising storing the first motion picture response function and the second motion picture response function corresponding to gray scales in at least one luminance query table.

4. The method as claimed in claim 2, wherein the step of generating a luminance corresponding to the second frame according to the third average gray scale and at least one luminance query table comprises looking up the luminance query tables through the third average gray scale to generate a third motion picture response function and fourth motion picture response function corresponding to the third average gray scale.

5. The method as claimed in claim 4, wherein the step of generating a luminance corresponding to the second frame according to the third average gray scale and at least one luminance query table further comprises generating the first frame and the second frame respectively corresponding to the third motion picture response function and the fourth motion picture response function.

6. A display, comprising:

a display panel displaying images having a plurality of frames; and a timing controller electrically connected to the display panel, the timing controller comprising:

a frame memory for receiving and temporarily storing a first frame, the first frame corresponding to a first average gray scale;

a gray scale curve amending module electrically connected to the frame memory and receiving a second frame, the second frame corresponding to a second average gray scale and being received later than the first frame;

a first luminance query table electrically connected to the display panel and the gray scale curve amending module; and a second luminance query table electrically connected to the display panel, the frame memory, and the gray scale curve amending module, wherein when the first gray scale is unequal with second gray scale, the gray scale curve amending module processes and transforms the second gray scale into a third average gray scale, the first luminance query table outputs a first sub-frame image to the display panel according to the third average gray scale, the second luminance query table outputs a second first sub-frame image to the display panel according to the second average gray scale, the display panel displays the second frame according to the first sub-frame and the second sub-frame, and wherein when the third average gray scale is greater than the first average gray scale and the second average gray scale, the first average gray scale is less than the second average gray scale, and a gray scale difference between the third average gray scale and the second average gray scale is greater than a critical gray scale difference or when the third average gray scale is less than the first average gray scale and the second average gray scale, the first average gray scale is greater than the second average gray scale, and a gray scale difference between the third average gray scale and the second average gray scale is less than a critical gray scale difference, wherein the critical gray scale difference is generated according to a gray scale difference between the first average gray scale and the second average gray scale.

7. The display as claimed in claim 6, wherein the display panel displays an image having a plurality of gray scales, and each motion picture response function corresponding to each gray scale is separated into a first motion picture response function and a second motion picture response function on a display panel.

8. The display as claimed in claim 7, wherein the first motion picture response function is stored in the first luminance query table, and the second motion picture response function is stored in the second luminance query table.

9. The display as claimed in claim 6, further comprising a signal generator electrically connected to the display panel, wherein the signal generator generates various control signals and transmits the control signals to the display panel.

* * * * *